US012281370B2

(12) United States Patent
Savoyat

(10) Patent No.: US 12,281,370 B2
(45) Date of Patent: Apr. 22, 2025

(54) METHOD FOR FIXING A RAIL OF A RAIL TRACK WITH THERMAL CONDITIONING OF A RAIL PORTION, AND ASSOCIATED RAIL MACHINE

(71) Applicant: MATISA MATERIEL INDUSTRIEL S.A., Crissier (CH)

(72) Inventor: Marc-Antoine Savoyat, Renens (CH)

(73) Assignee: MATISA MATERIEL INDUSTRIEL S.A., Crissier (CH)

( * ) Notice: Subject to any disclaimer, the term of this patent is extended or adjusted under 35 U.S.C. 154(b) by 1025 days.

(21) Appl. No.: 17/282,677

(22) PCT Filed: Oct. 1, 2019

(86) PCT No.: PCT/EP2019/076658
§ 371 (c)(1),
(2) Date: Apr. 2, 2021

(87) PCT Pub. No.: WO2020/070168
PCT Pub. Date: Apr. 9, 2020

(65) Prior Publication Data

US 2021/0348246 A1 Nov. 11, 2021

(30) Foreign Application Priority Data

Oct. 2, 2018 (FR) ..... 1859128

(51) Int. Cl.
*C21D 9/04* (2006.01)
*E01B 29/17* (2006.01)
*E01B 31/18* (2006.01)

(52) U.S. Cl.
CPC ..... *C21D 9/04* (2013.01); *E01B 29/17* (2013.01); *E01B 31/18* (2013.01); *C21D 2221/00* (2013.01); *C21D 2221/10* (2013.01)

(58) Field of Classification Search
CPC ..... E01B 31/18; E01B 29/17; E01B 29/44; C21D 9/04; C21D 2221/00; C21D 2221/10
See application file for complete search history.

(56) References Cited

U.S. PATENT DOCUMENTS 3,266,956 A * 8/1966 Bennewitz ..... C21D 9/04 148/645
3,566,796 A * 3/1971 Herrick ..... E01B 31/18 104/2

(Continued)

FOREIGN PATENT DOCUMENTS

EP 0467833 1/1992
EP 0765942 2/1997

(Continued)

OTHER PUBLICATIONS

PCT/EP2019/076658, Oct. 31, 2019, English Translation of International Search Report and Written Opinion.

*Primary Examiner* — S. Joseph Morano
*Assistant Examiner* — Cheng Lin
(74) *Attorney, Agent, or Firm* — RAY QUINNEY & NEBEKER P.C.; Paul N. Taylor

(57) ABSTRACT

In order to fix a rail of a rail track using a rail machine, the rail machine is moved in a working direction so that at all times a portion of the rail which is not attached to a cross-member of the rail track passes through a thermal conditioning zone of a thermal conditioning device of the rail machine, a temperature of a surface region of the portion of the rail passing through the thermal conditioning zone is modified using the thermal conditioning device by generating a non-homogeneous temperature distribution in the portion of the rail, and the portion of the rail is fixed to a cross-member of the rail track, after modification of the temperature of the surface region of the portion of the rail, (Continued)

without waiting for the temperature distribution in the portion of the rail to be homogenized.

9 Claims, 1 Drawing Sheet

(56) References Cited

U.S. PATENT DOCUMENTS

| | | | | | |
|---|---|---|---|---|---|
| 3,896,734 | A * | 7/1975 | Plasser | E01B 29/44 | 104/2 |
| 4,860,727 | A * | 8/1989 | Eads | E01B 19/00 | 126/271.2 A |
| 5,237,143 | A * | 8/1993 | Scheuchzer | E01B 29/17 | 104/5 |
| 5,299,504 | A * | 4/1994 | Abele | E01B 31/18 | 104/2 |
| 5,916,387 | A * | 6/1999 | Dannenberg | C21D 1/30 | 148/581 |
| 6,308,635 | B1 * | 10/2001 | Abele | E01B 31/18 | 104/2 |
| 10,676,873 | B2 * | 6/2020 | Ganz | E01B 29/44 | |
| 2015/0257206 | A1 * | 9/2015 | Dickson | H05B 6/06 | 219/653 |

FOREIGN PATENT DOCUMENTS

| | | |
|---|---|---|
| EP | 2037720 | 3/2009 |
| FR | 2904335 | 2/2008 |
| WO | WO 2017017600 | 2/2017 |

* cited by examiner

METHOD FOR FIXING A RAIL OF A RAIL TRACK WITH THERMAL CONDITIONING OF A RAIL PORTION, AND ASSOCIATED RAIL MACHINE

TECHNICAL FIELD OF THE INVENTION

The invention relates to laying a rail of a railway track, and more particularly to an operation of thermal conditioning of a portion of the rail before it is laid. It relates both to a rail machine allowing said operation of thermal conditioning, and to a method of immobilization, including said operation. It relates to laying a new rail on a pre-existing track, laying a new rail on a new track, and a maintenance operation on a pre-existing rail, which includes an operation of deposition followed by an operation of laying. The rail machine may be an autonomous machine, a replacing train, or a laying train.

PRIOR ART

The rails of railway tracks are subjected to significant temperature variations depending on the seasons and the meteorological conditions. The rails tend to extend and dilate under the effect of an increase in temperature, and, vice versa, to contract under the effect of a drop in temperature.

Nowadays, the rails are laid such that they are welded end-to-end, in a continuous manner, and thus fixed to the sleepers, such that the rails cannot vary in length under the effect of temperature variations. Under the effect of an increase in the ambient temperature above the laying temperature, the rails, being unable to dilate, are subjected to a compression force which tends to push the track out of its path. Vice versa, under the effect of a reduction in the temperature below the laying temperature, the rails, being unable to contract, are subjected to a traction force which tends to pull the track out of its path.

In order to minimize the impact of the temperature variations, it is desirable to fix the rails on the track at a predetermined temperature referred to as "neutral," the value of which differs depending on the climatic regions, and which may correspond for example to a mean or median temperature of the laying location, recorded over a long period, if applicable several years. It is thus ensured that the range of variations of stresses inside the rail, and the variation of forces on the track, will be minimized.

EP 0 467 833 shows a work train comprising an induction heating station for a previously raised rail, and an immobilization zone for immobilizing the rail on the sleepers of the track, with a view to its subsequent fixing by means of clips. The induction heating generates an induced current, in the portion of the rail passing through a heating zone of the heating station, which induced current increases the temperature of the rail portion by means of the Joule effect. However, the circulation of electrons in the rail is not uniform, and a skin effect is observed, which becomes increasingly sensitive as the induction frequency increases. This results in a significant inhomogeneous distribution of the temperature within the rail, at the output of the heating zone. The immobilization zone of the rail is located at a distance from the heating station, such that the temperature has the time to homogenize in the rail, in other words such that the difference between the surface temperature and the temperature within the core of the rail is below a predetermined threshold, the aim being for the rail to have reached a homogeneous temperature in the region of the immobilization zone, equal to the predetermined neutral temperature of the location. By way of example, for a work train travelling at 6 meters per minute, a distance of 17 meters is provided between the output of the heating station and the immobilization zone of the rail, which corresponds to a homogenization time of 170 seconds.

Other heating methods may be implemented. It has thus been proposed to expose the rail to infrared radiation. It is found, however, that the infrared radiation penetrates only a little way into the material, and brings about only surface heating, with a skin effect of approximately 100 nm. Other forms of heating, in particular by spraying water or by exposure to a flame of a burner, have been proposed, but also result in heating that is limited to the surface of the rail.

Proceeding from the premise that it is necessary to achieve homogenization of the temperature in the rail at the neutralization temperature before immobilization of the rail on the sleepers, the concept of the need to provide a homogenization time, and thus a significant distance between the main heating station and the immobilization zone of a work rail machine, has won recognition in the prior art.

This provision is not without disadvantages, however. Firstly, it impacts the size of the rail machine, which is provided with means for making the rail travel between the heating station and the immobilization zone. Furthermore, measures must be taken to limit and control the thermal losses in the space separating the heating zone from the immobilization zone, in order to limit the power consumption and ensure that, in the region of the immobilization zone, the homogeneous temperature achieved is indeed the "neutral" setpoint temperature. Finally, the operating difficulties arise each time the rail machine is caused to stop in an unforeseen manner, since, after a certain time, the rail portion located between the heating station and the immobilization zone is no longer at the desired temperature, and a specific procedure must be implemented upon each restart. It is moreover this which has led, in W02017/017600A1, to it being proposed to interpose, between the heating device and the immobilization zone, a thermal isolation divider portion or a complementary thermal treatment portion, the aim of which is to compensate the thermal losses between the heating station and the immobilization zone.

When it is necessary to cool the rail before immobilization, the cooling methods also pass through cooling of the surface of the rail, thus leading to non-homogeneous cooling of the rail, with similar difficulties.

In order to resolve these problems, it would theoretically be possible to call on technologies which allow for uniform heating of the rail, for example by passages of a continuous current in the rail. However, a technology of this kind is found to be difficult to implement in practice.

DISCLOSURE OF THE INVENTION

The invention aims to overcome the disadvantages of the prior art and to simplify the immobilization of a rail at a setpoint temperature referred to as "neutral."

In order to achieve this, according to a first aspect of the invention a method for immobilizing a rail of a railway track by means of a rail machine is proposed, according to which method:

- the rail machine is moved in a work direction, such that, at each moment, a portion of the rail not fixed to a sleeper of the railway track passes through a thermal conditioning zone of a thermal conditioning device of the rail machine;

a temperature of a surface region of the portion of the rail passing through the thermal conditioning zone is changed by means of the thermal conditioning device, by generating a non-homogeneous temperature distribution in the rail portion; and the portion of the rail is fixed on a sleeper of the railway track after the temperature of the surface region of the portion of the rail has been changed, but without waiting for the temperature distribution in the portion of the rail to be homogenized.

Indeed, the inventors suspected, and then verified by way of calculation and experimental trials, that it was not necessary to achieve homogenization of the temperature in the rail in order to achieve the sought effect, i.e. an extension of the rail, or a length of the rail portion being laid which corresponds to the extension and the length recorded at the neutral temperature. The theoretical study is based on two results:

the conservation of the average temperature of the rail during the homogenization;

the proportionality between the extension of the rail and the average stress in the transverse cross section observed.

If C designates the thermal capacity of steel (in J/kg/K), p designates the density of steel (in kg/m$^3$), and V designates the rail volume in question (in m$^3$), the thermal energy present in the rail, at the output of the thermal conditioning zone, is, by definition:

$$E_0=\iiint_V C\cdot T_0\cdot\rho\cdot dv=C\cdot\rho\cdot\iiint T_0\cdot dv$$

An average temperature of the rail $T_{0\ moy}$ can be defined such that:

$$T_{0moy}=\frac{1}{V}\int\int\int_V T_0.dv$$

It follows therefrom that:

$$E_0=C\cdot\rho\cdot V\cdot T_{0\ moy}$$

If $T_1=T_{1\ moy}$ designates the uniform temperature of the rail obtained after homogenization, and $E_1$ designates the thermal energy of the rail after uniformization, the following is achieved:

$$E_1=C\cdot\rho\cdot V\cdot T_{1\ moy}$$

However, if it is observed that the constant of the temperature homogenization time (2 to 3 minutes) is very small compared with the constant of the cooling time of the rail in its entirety (100 to 200 minutes), it can be considered that the transformation corresponding to the homogenization is adiabatic, such that thermal energy is conserved. Thus:

$$E_0=E_1$$

Therefore, after simplification, the following results:

$$T_{0\ moy}=T_{1\ moy}$$

It is thus established that the average temperature at the output of the conditioning zone is equal to the homogenization temperature of the rail.

If S designates the surface of the rail section, E the Young's modulus, and α the coefficient of elongation of the rail, it is possible to express the average stress in the section of the rail in the following manner:

$$\sigma=\frac{1}{S}\cdot\int\int_S\sigma(s).ds=\frac{1}{S}\cdot\int\int_S E.\alpha.\Delta T(s).ds=E.\alpha.\left[\frac{1}{S}\cdot\int\int_S\Delta T(s).ds\right]$$

It is possible to define a variation of the average temperature $\Delta T_{moy}$ in the rail section, which is equal to the average of the local temperature variations in the rail section, such that:

$$\Delta T_{moy}=\frac{1}{S}\cdot\int\int_S\Delta T(s).ds$$

Thus, the average stress is written as a function of the average temperature variation:

$$\sigma=E\cdot\alpha\cdot\Delta T_{moy}$$

Furthermore, Hooke's law on elasticity makes it possible to link the average stress to the relative extension (disregarding the variations of the section):

$$\sigma=E.\frac{\Delta L}{L_0}$$

The relation of proportionality against the relative extension and the variation of the average temperature of the section is derived therefrom:

$$\frac{\Delta L}{L_0}=\alpha.\Delta T_{moy}$$

In other words, the extension of a rail section is proportional to the average temperature recorded in the rail section, but independently of the distribution of temperatures in the rail section.

In practice, the rail machine moves in the work direction at a constant speed, which can be referred to as nominal, for given working conditions (geometry of the track, type of work to be carried out). For information purposes, said speed is typically in a bracket of 100 to 1200 m/hour.

Preferably, the portion of the rail is fixed to the sleeper less than 50 seconds, preferably less than 30 seconds, after the portion of the rail has left the thermal conditioning zone. It is important that the time that passes between emergence from the thermal conditioning zone and the fixing of the rail on the sleeper should be minimal, in order to limit the convective heat exchanges with the ambient environment.

In some conditions, the temperature distribution at the output of the thermal conditioning zone may be very inhomogeneous and remain very inhomogeneous at the time of the immobilization of the rail. For example, it is possible to find that, at the moment of immobilization of the portion of the rail, there is a difference of more than 50° C. between at least one point of the surface of the rail portion and at least one point of the core of the rail portion.

According to an embodiment, the change in the temperature in a surface region of the portion of the rail passing through the thermal conditioning zone is such that the average temperature of the rail portion at the outlet of the thermal conditioning zone is equal to within +/−5° C., and preferably to within +/−3° C., and preferably to within +/−2°

C., and preferably to within +/−1° C., and preferably exactly, to a predetermined setpoint temperature of the laying location.

In this case, average temperature means the volume integral of the elementary temperatures in the portion of the rail:

$$T_{moy} = \frac{1}{V}\int\int\int_V T(v).dv$$

The passage through the thermal conditioning zone is accompanied by a heat transfer equal to the quantity of heat required for bringing the rail portion to an average temperature that is equal to within +/−5° C., and preferably to within +/−3° C., and preferably to within +/−2° C., and particularly preferably to within +/−1° C., and preferably exactly, to a predetermined setpoint temperature of the immobilization location, at the output of the thermal conditioning zone.

Insofar as the transition between the output of the thermal conditioning zone and the immobilization zone is brief, it is possible to consider that the heat exchanges between the rail and the environment are small. From then on, the change in the temperature in a surface region of the portion of the rail passing through the thermal conditioning zone results in a transfer of an amount of heat equal to the amount of heat required for bringing the section of rail, under adiabatic conditions, to a homogenization temperature equal to a temperature in the predetermined tolerance range, preferably +/−5° C., preferably +/−3° C., preferably +/−2° C., and preferably +/−1° C. around, and preferably exactly to, a predetermined setpoint temperature.

In other words, the thermal conditioning zone is the location of a transfer of thermal energy which may be positive or negative and the value ΔE of which is equal to the difference between the thermal energy $E_A$ of the rail before entry into the thermal conditioning zone, and the thermal energy EN of the rail in an ideal state, at a homogeneous temperature equal to the neutral temperature $T_N$ (or the difference between the thermal energy $E_A$ of the rail before entry into the thermal conditioning zone and the thermal energy $E_C$ of the rail in a target state at a homogeneous temperature equal to a target temperature $T_C$ equal to the neutral temperature $T_N$, to within +/−5° C., and preferably to within +/−3° C., and preferably to within +/−2° C., and particularly preferably to within +/−1° C., and preferably exactly). Assuming that the rail is in thermal equilibrium with its environment before entering the thermal conditioning zone, i.e. at a homogeneous temperature that is equal to the ambient temperature $T_A$, it can be stated that:

$$\begin{cases} E_N = C.\rho.V.T_N \\ E_A = C.\rho.V.T_A \\ \Delta E = E_N - E_A = C.\rho.V.(T_N - T_A) \end{cases}$$

The heat exchange device is preferably controlled depending on one or more control variables, including one or more of the following measured or estimated variables: a temperature of the portion of the rail at the entry into the thermal conditioning zone, a temperature of the portion of the rail at the output of the thermal conditioning zone, a temperature of the portion of the rail in the thermal conditioning zone, a temperature of the portion of the rail in the region of the immobilization zone, a temperature of the rail portion after the immobilization zone, an outside ambient temperature, a movement speed of the rail machine, a movement speed of the rail with respect to the thermal conditioning device, a duration of passage in the thermal conditioning zone, a deviation between a setpoint temperature and a measured temperature of the portion of the rail before thermal conditioning, a deviation between a setpoint temperature and a measured temperature of the portion of the rail after thermal conditioning, a deviation between a setpoint temperature and a measured temperature of the portion of the rail during the supply of heat, a deviation between a setpoint temperature and a temperature of the portion of the rail in the region of the immobilization zone, a deviation between a setpoint temperature and a temperature of the rail portion after the immobilization zone, an ambient humidity, or a wind speed.

According to an embodiment, one or more of the following temperatures are measured:

- at least one temperature of the portion of the rail after the heat input, by means of at least one thermometer (for example a pyrometer or a thermocouple) arranged in the region of an output zone of the thermal conditioning zone or behind the thermal conditioning zone in the work direction;
- at least one temperature of the portion of the rail before the heat input, by means of at least one thermometer (for example a pyrometer or a thermocouple) arranged in the region of an input zone of the thermal conditioning zone or in front of the thermal conditioning zone in the work direction;
- at least one temperature of the portion of the rail during the heat input, by means of at least one thermometer (for example a pyrometer or a thermocouple) arranged inside the thermal conditioning zone;
- at least one temperature of the portion of the rail after immobilization, by means of at least one thermometer (for example a pyrometer or a thermocouple) arranged in the region of the immobilization zone or after the immobilization zone in the work direction.

According to an embodiment, the portion of the rail passing through the thermal conditioning zone is raised with respect to the railway track. It is possible to provide, if applicable, for the rail machine to comprise a positioning device for positioning the rail portion on the track, located between the thermal conditioning device and the immobilization zone of the rai portion on a sleeper of the track. In this case, the positioning device must preferably be compact, in order for the corresponding positioning zone to be short.

Alternatively, the positioning of the rail portion on the track can be performed in the thermal conditioning zone.

According to another alternative embodiment, the portion of the rail passing through the thermal conditioning zone rests on a sleeper of the railway track. The immobilization of the portion of the rail on the sleeper is the operation which immediately follows the passage of the same portion of the rail through the thermal conditioning zone.

Preferably, the temperature of a surface region of the portion of the rail passing through the thermal conditioning zone is changed by means of heat exchange with a heat source, hot or cold, in particular by thermal radiation, thermal conduction, and/or convection, or by an alternating electrical current induced or generated in the rail portion.

According to another aspect of the invention, this relates to a rail machine comprising:

- at least one thermal conditioning device comprising at least one thermal conditioning zone;

traction means for moving the rail machine in a work direction at a predetermined operating speed, such that, at each moment, a portion of the rail that is not fixed to a sleeper passes through the thermal conditioning zone; the thermal conditioning device being capable of changing a temperature in a surface region of the portion of the rail passing through the thermal conditioning zone by means of the thermal conditioning device, by generating a non-homogeneous temperature distribution in the rail portion;

an immobilization zone of the portion of the rail on a sleeper of the railway track, located behind the thermal conditioning zone in the work direction, the immobilization zone being positioned such that, at the predetermined operating speed, the distance between the immobilization zone and the thermal conditioning zone is travelled in less than 170 seconds, preferably less than 120 seconds, preferably less than 60 seconds, preferably less than 50 seconds, preferably less than 30 seconds.

Preferably, the thermal conditioning device is capable of supplying to the rail portion passing through the thermal conditioning zone, and/or extracting from the rail portion passing through the thermal conditioning zone, a higher amount of heat which is sufficient for increasing and/or decreasing, by at least 5° C., the average temperature of the rail portion, for a U1C60 rail, when the rail machine advances in the work direction at the predetermined operating speed.

According to an embodiment, the rail machine comprises means for changing the temperature of a surface region of the portion of the rail passing through the thermal conditioning zone, via an alternating electrical current induced or conducted in the rail portion, or by heat exchange with a heat source, hot or cold, in particular by thermal radiation, thermal conduction, and/or convection.

BRIEF DESCRIPTION OF THE FIGURES

Other features and advantages of the invention will become clear from the following description, given with reference to the accompanying drawings, in which.

For reasons of improved clarity, identical or similar elements are indicated by identical reference signs in all the figures.

DETAILED DESCRIPTION OF EMBODIMENTS

Figure 1:
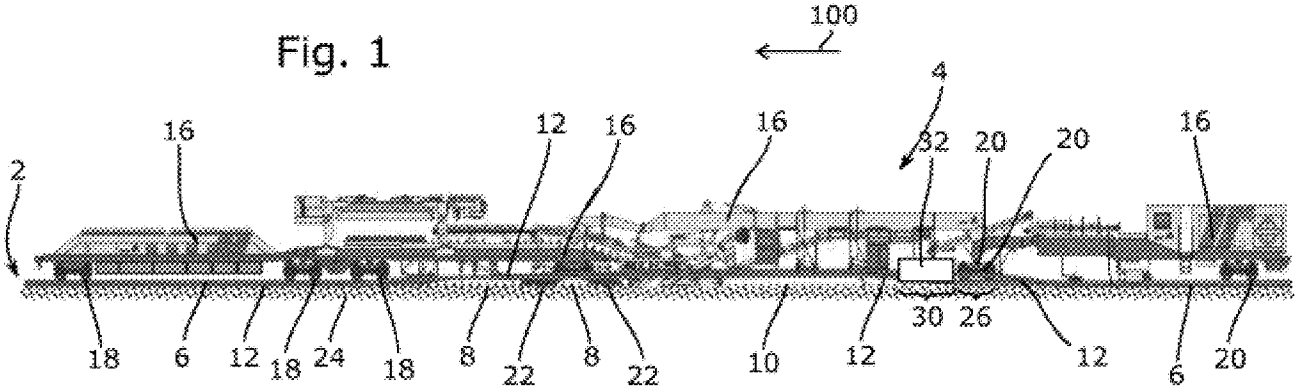
FIG. 1 is a schematic view of a site for laying a rail of a railway track according to the method of the invention.
Figure 2:
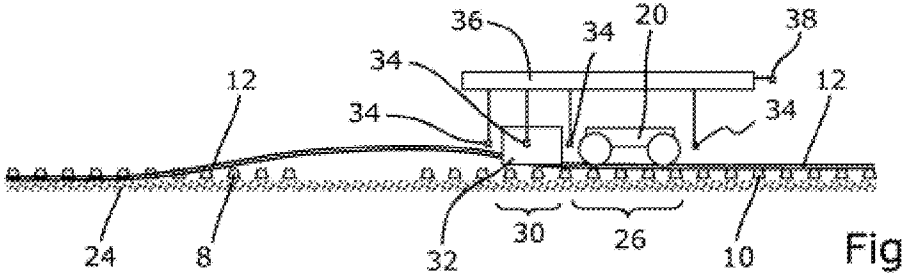
FIG. 2 is a schematic detailed view of the site of FIG. 1, showing the thermal conditioning and the fixing of a portion of rail according to the method of the invention.

FIG. 1 is a global view of a site for replacing a railway track 2, a site on which, by means of a replacing train 4 (shown in part), old rails 6 (front sector) and old sleepers 8 are deposited and are replaced by new sleepers 10 and new rails 12, all this being carried out continuously as the replacing train 4 advances, at a constant speed in a work direction 100. The replacing train 4 comprises wagons 16 resting on bogies 18, 20 which roll on the old rails 6 in the front part of the replacing train 4 and on the new rails 12 in the rear part of the replacing train 4. A mid-part of the replacing train 4 in turn rests on caterpillar tracks 22 which, in the absence of rails on the track 2 in this part of the site, roll directly on the ballast 24 and the old sleepers 8 before they are deposited.

On a front portion of the site, tools make it possible to separate the old rails 6 from the sleepers 8. Gradually, during their disassembly, the old rails 6 are raised and placed down on the ballast 24 on the sides of the track. On the front portion of the site, the old sleepers 8 are exposed, which makes it possible to continue to the deposition thereof by means of a group of deposition tools, and to the replacement thereof by the new sleepers 10 by means of a group of laying tools. The new rails 12 which, prior to the passage of the replacing train 4, were arranged on the ground on either side of the track 2, on wheels in order to allow for thermal dilation of the rail free of stress towards the front of the train, are raised and positioned, adhering to the desired geometry of the track 2, before being laid on the new sleepers 10. The immobilization of the new rails 12 is achieved by the weight of the rail machine in the region of the immobilization zone 26, also referred to as the anchoring zone, located in the region of a bogie 20, in the rear part of the replacing train 4. In a known manner, the actual fixing of the new rails 12 is performed downstream, by means of fasteners.

In order to prevent or limit the risk of deterioration of the track under the effect of variations of climatic or meteorological conditions, it is provided for the new or restored rails 12 to be fixed on the sleepers, by bringing said metal profiles to a setpoint temperature, referred to as "neutral."

For this purpose, the portion of new or restored rail to be laid 12 is brought to a setpoint temperature in a thermal conditioning zone 30 of a thermal conditioning device 32, the thermal conditioning zone 30 being located upstream of and close to the immobilization zone 26 of the rail on one or more sleepers 10, or even directly adjacently to the immobilization zone 26. If applicable, the actual immobilization zone 26 can be preceded by a rail positioning zone which may be located between the thermal conditioning zone 30 and the immobilization zone 26 (in the event of the rail being raised in the thermal conditioning zone) or upstream of the thermal conditioning zone (in the event of the rail already resting on the new sleepers 10 in the thermal conditioning zone 30). Alternatively, the positioning zone of the rail coincides with the immobilization zone 26 or the thermal conditioning zone 30.

When the intervention on the site takes place at a moment when the ambient temperature is lower than the setpoint temperature referred to as "neutral," the thermal conditioning comprises heating of the rail, the thermal conditioning device 30 is converted into a heating device, the thermal conditioning zone 30 thus being a heating zone. Said heating can be carried out by the means typically used, which have in common the characteristic that they do not generate a homogeneous distribution of the temperature in the rail, but on the contrary bring about a significant temperature difference between particular heated zones at the surface of the rail or in the vicinity of the surface of the rail, and the less heated zones located in the center of the rail. The heating can in particular be achieved by electrical induction into the rail, by spraying of hot water, by infrared radiation, or by exposure to heat transfer fluid (water, air, vapor, combustion gas, flame).

Vice versa, when the ambient temperature is greater than the setpoint temperature referred to as "neutral," the thermal conditioning comprises cooling of the rail, the thermal conditioning device 30 is converted into a cooling device, the thermal conditioning zone 30 thus being a cooling zone. Said cooling can in particular be achieved by means of exposure to a heat transfer fluid.

Notably, the immobilization zone 26 is positioned, with respect to the thermal conditioning device 32, such that when the replacing train 4 advances in the work direction 100 at a nominal operating speed, the portion of the rail that left the thermal conditioning device 32 having a non-homogeneous temperature distribution reaches its immobilization position on the sleeper in the immobilization zone 26 before homogenization of the temperature distribution, in a transverse cross section of the rail portion, has taken place.

By way of example, the immobilization zone 26 is located at least five meters form the thermal conditioning zone 30, for a replacing train travelling at a nominal speed of 500 m/hour, such that a portion of the rail reaches the immobilization zone 26 less than 36 seconds after emerging from the thermal conditioning zone 30.

In practice, it is of interest to reduce, as far as possible, the distance between the output of the thermal conditioning zone 30 and the immobilization zone 26, in order to simplify the restarting of the replacing train 4 after a period of stoppage, by reducing the rail portion of which the temperature is no longer in the tolerance interval allowing the anchoring thereof, and located between the thermal conditioning zone 30 and the immobilization zone 26. It is thus provided in particular for the output of the thermal conditioning zone 30 to be able to coincide, spatially, with the immobilization zone 26.

Thermometers 34 are positioned at the input of the thermal conditioning zone 30, inside the thermal conditioning zone 30, at the output of the thermal conditioning zone 30, and, if applicable, directly in the vicinity of the immobilization zone 26. Said thermometers 34 are connected to a control unit 36 which receives signals of other sensors 38 such as, for example: a speed sensor of the replacing train 4, a speed sensor of the rail to be processed, an ambient temperature sensor, an atmospheric pressure sensor, and/or an ambient humidity sensor. The control unit 36 is thus capable of measuring, estimating or calculating one or more of the following parameters: an average temperature of the portion of the rail to be processed prior to thermal conditioning, an average temperature of the portion of the rail after the thermal conditioning, a temperature of the portion of the rail during the thermal conditioning, a temperature of the portion of the rail after anchoring thereof, an external ambient temperature, a movement speed of the replacing train 4, a movement speed of the rail with respect to the thermal conditioning device, an amount of heat transmitted to the portion of the rail by the thermal conditioning device.

Furthermore, the control unit 36 contains, in a memory, a setpoint temperature which may have been acquired or programmed, and is representative of the neutral temperature sought in the immobilization zone 26, which makes it possible, if applicable, to determine a deviation between the setpoint temperature and an average temperature of the portion of the rail to be processed, before thermal conditioning, a deviation between the setpoint temperature and an average temperature of the portion of the rail after thermal conditioning, or a deviation between the setpoint temperature and an average temperature of the portion of the rail during the thermal conditioning. In a known manner, the control unit 36 is suitable for modulating the power of the thermal conditioning device.

When the replacing train 4 advances in a work direction 100, the rail to be processed 12 moves, with respect to the thermal conditioning device 30, in the opposite direction, and is guided such that, at every moment, a raised portion of the rail to be processed 12 passes through the thermal conditioning zone 30. If applicable, the positioning of the thermal conditioning device is adjusted by means of actuators or a positioning mechanism.

It is thus ensured that, at every moment and depending on the advancement of the replacing train 4, a portion of the rail to be processed 12 passes through the thermal conditioning zone 30 where, according to the extreme conditions, it is heated or cooled by the thermal conditioning device 32 such that the average temperature in the portion of the rail at the output of the thermal conditioning zone is equal to the setpoint temperature. The control unit 36 determines, by means of a calculation algorithm, on the basis of all or some of the parameters discussed above, the thermal energy which has to be transferred to the rail to be processed 12 or which has to be extracted, in order to obtain said average temperature.

From the output of the thermal conditioning zone 30, and although the temperature thereof is very inhomogeneous, the portion of the rail 12 has reached the extension corresponding to the extension of a rail at a homogeneous temperature that is equal to the setpoint temperature. The portion of the rail to be processed 12 penetrates, immediately or almost immediately, into the immobilization zone 26, where it is subsequently fixed onto a sleeper 10 of the railway track, less than 50 seconds, and preferably less than 30 seconds after emerging from the thermal conditioning zone 30. In this short time lapse, the losses due to convective exchange with the ambient air are negligible.

Of course, the examples shown in the drawings and discussed above are given merely by way of example and are non-limiting.

The mode of thermal conditioning of the rails which has been described for a renovation of the railway track, replacing rails, also applies for a renovation of the track replacing old rails, or for first laying, or indeed for thermal maintenance treatment.

What has been describe for a replacing train can be transferred to an autonomous rail machine or a laying train.

The invention claimed is:

1. A method of immobilizing a rail of a railway track by means of a rail machine, comprising:

moving the rail machine in a work direction, such that, at each moment, a portion of the rail not fixed to a sleeper of the railway track passes through a thermal conditioning zone of a thermal conditioning device of the rail machine;

a temperature of a surface region of the portion of the rail passing through the thermal conditioning zone is changed by means of the thermal conditioning device, by generating a non-homogenous temperature distribution in the portion of the rail;

wherein the portion of the rail is fixed on a sleeper of the railway track after the temperature of the surface region of the portion of the rail has been changed, but without waiting for the temperature distribution in the portion of the rail to be homogenized.

2. The method of claim 1, wherein the portion of the rail is fixed to the sleeper less than 50 seconds after the portion of the rail has left the thermal conditioning zone.

3. The method of claim 1, wherein the change in the temperature in a surface region of the portion of the rail passing through the thermal conditioning zone is such that an average temperature of the portion of the rail at an outlet of the thermal conditioning zone is within +/−5° C. of a predetermined setpoint temperature of a laying location.

4. The method of claim 1, wherein the change in the temperature in a surface region of the portion of the rail passing through the thermal conditioning zone results in a transfer of an amount of heat equal to the amount of heat required for bringing a section of rail, under adiabatic conditions, to a homogenization temperature equal to a temperature in a predetermined tolerance range of +/−5° C. around a predetermined setpoint temperature.

5. The method of claim 1, wherein the portion of the rail passing through the thermal conditioning zone is raised with respect to the railway track.

6. The method of claim 1, wherein the portion of the rail passing through the thermal conditioning zone rests on a sleeper of the railway track.

7. The method of claim 1, wherein the temperature of a surface region of the portion of the rail passing through the thermal conditioning zone is changed by means of heat exchange with one or more of a heat source, hot or cold, by thermal radiation, thermal conduction, or convection.

8. The method of claim 1, wherein the temperature of a surface region of the portion of the rail passing through the thermal conditioning zone is changed by means of heat exchange with one or more of a heat source, by thermal radiation, thermal conduction, or convection.

9. The method of claim 1, wherein the temperature of a surface region of the portion of the rail passing through the thermal conditioning zone is changed by means of an alternating electrical current induced or generated in the portion of the rail.

* * * * *